United States Patent [19]

Larsen

[11] 4,076,042

[45] Feb. 28, 1978

[54] CUT-OFF VALVE FOR OIL FIRING INSTALLATIONS

[75] Inventor: Peder Larsen, Augustenborg, Denmark

[73] Assignee: Danfoss A/S, Nordborg, Denmark

[21] Appl. No.: 746,475

[22] Filed: Dec. 1, 1976

Related U.S. Application Data

[63] Continuation-in-part of Ser. No. 611,196, Sept. 8, 1975, abandoned.

[30] Foreign Application Priority Data

Dec. 10, 1973 Germany ..... 2361380

[51] Int. Cl.[2] ..... F16K 31/12

[52] U.S. Cl. ..... 137/494; 137/510

[58] Field of Search ..... 137/509, 494, 510, 511

[56] References Cited

U.S. PATENT DOCUMENTS

| | | | |
|---|---|---|---|
| 3,099,997 | 8/1963 | Krottke | 137/509 |
| 3,414,009 | 12/1968 | Merchant | 137/494 |
| 3,419,039 | 12/1968 | Monnich | 137/510 |
| 3,754,567 | 8/1973 | Whitten | 137/509 |

*Primary Examiner*—Harold W. Weakley

[57] ABSTRACT

The invention relates to a cut-off valve assembly for an oil burner assembly. The cut-off valve is of the type which is spring biased and rapidly opens and closes above and below a predetermined pump pressure. The rapid closing is to prevent fuel oil from dripping from the nozzle. The valve assembly has an expansible chamber formed with a diaphragm. The chamber has inlet and outlet ports with a valve seat formed on the outlet port. A spring biased adjustment element has a disk shaped portion below the diaphragm which carries a closure member for the outlet port. The face of the closure member is displaceable relative to the disk shaped portion and is of a larger diameter than the diameter of the valve seat for the outlet port. The closure member is a member loaded by a lever and the lever is supported on the one side approximately centrally on a bearing loaded by the desired value spring and on the other side, the side opposite the closure member, at an eccentric position of the servo-element by way of a shorter lever arm. With this construction the elastic force loading the closure member is derived from the desired value spring but converted by the lever to a value corresponding to the size of the closure member. This construction facilitates the rapid opening and closing of the cut-off valve assembly.

1 Claim, 6 Drawing Figures

CUT-OFF VALVE FOR OIL FIRING INSTALLATIONS

This is a continuation-in-part of my application Ser. No. 611,196 filed Sept. 8, 1975, now abandoned.

The invention relates to a cut-off valve for oil firing installations in which a valve chamber is bounded on one side by a servo-element which is loaded on the side remote from the valve chamber by a desired value spring and is provided on the other side with a cut-off valve seat co-operating with a closure member.

In known cut-off valves, the servo-element is joined in one piece with the closure member of the cut-off valve. As soon as the feed pressure in the valve chamber exceeds the prestress of the desired value spring, the cut-off valve opens. When the feed pressure is below this value, the cut-off valve closes. To obtain more rapid closing, as is desired to avoid the dripping of oil from the nozzle, it has already been suggested to build a return flow piston into the piston that is provided as the servo-element, the return flow piston creating an additional connection to the return flow side when the pressure drops off and the valve suddenly closes as a result of a rapid pressure drop.

The invention is based on the object of providing a cut-off valve of the aforementioned kind which has a simple construction, opens and closes instantaneously and can also operate in conjunction with other servo-elements, particularly with a supporting member that is covered by a diaphragm.

This object is achieved according to the invention in that the closure member is displaceable axially of the servo-element against an elastic force under the influence of the pressure existing in the valve chamber.

With such a construction, the comparatively small closure member can move relatively to the servo-element and is also subjected to a force other than the desired value spring in the operating range. This gives the closure member the possibility of rapid movement. Since it is subjected to the pressure in the valve chamber only in the outer region in the closed condition, but the full area is immediately subjected to this pressure during opening, this results in the desired sudden opening. Conversely, if the central portion is covered by the cut-off valve seat during closure, the load on the closure member is reduced suddenly so that the cut-off will also occur suddenly.

The cut-off valve is also suitable for cases where the feed pressure of the pump is subjected to periodic fluctuations, as is the case with a magnetic pump. In that case one can use a servo-element having comparatively large dimensions and that does not tend to follow these pressure fluctuations. A closure member with comparatively smaller dimensions will, when the opening pressure is exceeded, open suddenly but then remain in the open condition until the pressure drops below the closing pressure which is to a certain extent smaller than the opening pressure. Within this pressure range, the periodic fluctuations of the pump have no detrimental influence on the operation of the cut-off valve.

In a preferred embodiment, the closure member is mounted in a supporting member serving as the servo-element, the supporting member being covered by a sealing diaphragm that is clamped at the margin. With the aid of the supporting member covered by the diaphragm, a comparatively large surface can be produced which is small compared with the surface of the closure member. This facilitates the previously described operation.

In particular, the closure member may be covered by the diaphragm. The diaphragm is in this case utilized as a sealing element for the closure member.

An extremely simple construction will be obtained if the closure member is an elastic pad. This pad tends to deform under the pressure in the valve chamber so that the effective end face of the closure member is displaced relatively to the servo-element.

In another embodiment, the closure member is a member loaded by a lever and the lever is supported on the one side approximately centrally on a bearing loaded by the desired value spring and on the other side, the side opposite the closure member, at an eccentric position of the servo-element by way of a shorter lever arm. With this construction the elastic force loading the closure member is derived from the desired value spring but converted by the lever to a value corresponding to the size of the closure member.

In a further development of the invention, the supporting member can actuate by way of a pin of the closure member a pressure regulating valve which is upstream of the valve chamber and tends to throttle the flow to the valve chamber. In this way one achieves a combination of a regulating and cut-off valve having a very compact construction.

The cut-off valve is particularly suitable for a fuel oil feed installation with a magnetic pump as described in prior German Patent Application P 23 42 112.7-13.

The invention will now be described in more detail with reference to the examples illustrated in the drawing. In the drawing.

Figure 1:
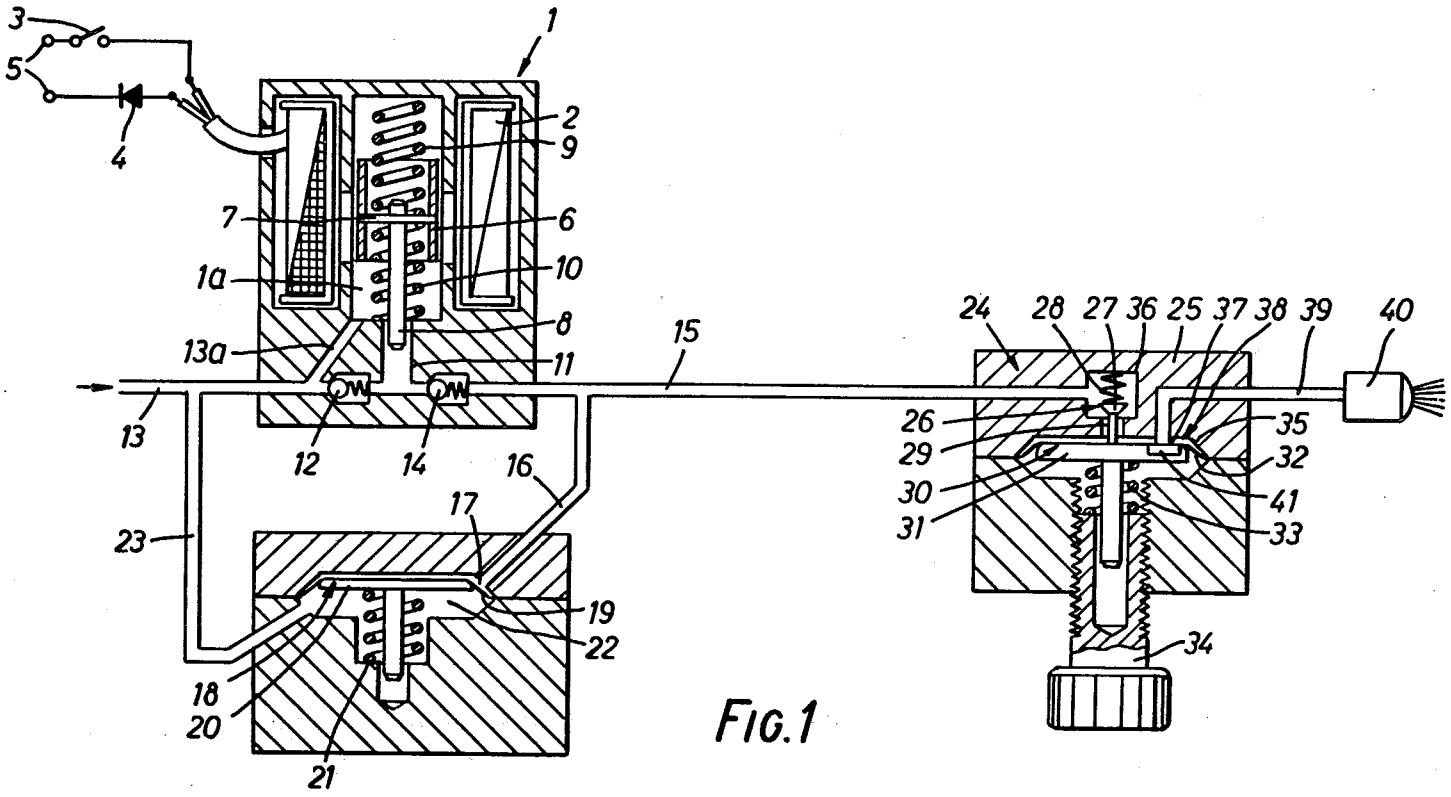
FIG. 1 is a diagrammatic representation of an oil firing installation with a cut-off valve according to the invention.

A magnetic pump 1 comprises an exciter coil 2 fed by way of a switch 3 and a one-way rectifier 4 by normal alternating current mains 5, for example at 220 V and 50 Hz. A cylindrical armature 6 is connected by a pin 7 to a pump piston 8. An upper compression spring 9 and a lower compression spring 10 supported by faces fixed with respect to the housing press on the pin 7. When the current is switched on, a current impulse is produced fifty times per second and this pulls the armature 6 downwardly. This leads to a periodic oscillation of the elastic oscillating system consisting of the integers 6 – 10.

The pump piston operates in a pump cylinder 11 which is connected by a suction valve 12 to a suction conduit 13 and by a pressure valve 14 to a feed conduit 15. A branch passage **13*a* connects the suction conduit 13 to the interior 1*a*** of the magnetic pump.

Leading from the feed conduit 15 to a storage chamber 17 there is a conduit section 16 which is bounded by a resilient wall 18. This wall is formed by a diaphragm 19 supported by a supporting plate 20 and a spring 21. Beneath the wall 18 there is defined a suction chamber 22 which is connected by a conduit section 23 to the suction conduit 13.

The feed conduit 15 leads to a combined pressure regulating and cut-off valve 24. It comprises a housing 25 with a pressure regulating valve 26 of which the closure member 27 is pressed against a servo-element 30 by a spring 28 with the interpositioning of a pin 29. This servo-element consists of a supporting member 31 which is covered by a diaphragm 32 clamped at the margin and loaded by a desired value spring 33. The latter is adjustable with the aid of a set screw 34. This servo-element bounds a valve chamber 35 on one side. On the other side there is an inlet aperture 36 controlled by the pressure regulating valve 26, and a seat 37 of a cut-off valve 38 which leads to an atomising nozzle 40 by way of a nozzle conduit 39. Co-operating with the valve seat 37 there is a closure member 41 which is here formed as an elastic pad and mounted in the servo-element 30.

In this installation, the function is as follows during normal operation. During each period of the oscillating system, the pump piston 8 executes a suction stroke and a compression stroke. During the suction stroke there is no feeding. During the compression stroke, a certain quantity Q is fed, half of which reaches the nozzle 40 through the pressure regulating valve 26 and the cut-off valve 38. The other half is led to the storage chamber 17, the wall 18 being deflected with compression of the spring 21. The potential energy thus stored serves to lead oil during the next suction stroke to the nozzle 40 by way of the pressure regulating valve 26 and the cut-off valve 38. One therefore obtains a substantially constant nozzle outlet quantity despite the intermittent feed.

Since during the suction stroke the pump piston 8 displaces oil from the chamber 1*a*, replenishment of the pump cylinder 11 takes place primarily by means of oil from the chamber 1*a*. The suction effect of the piston 8 is therefore restricted to the function of sucking oil into the chamber 1*a* during the compression stroke. By using the suction chamber 22, a suction effect is also obtained during the suction stroke of the piston 8 when the storage chamber 17 is reduced. Accordingly, oil flows in one direction through the suction conduit 13 during the compression stroke as well as during the suction stroke of the piston 8. One obtains a substantially continuous mean flow which gives rise to comparatively small impacts and knocking.

The pressure regulating valve works in a manner such that with increasing feed pressure the diaphragm 32 is pressed downwardly against the force of the spring 33 and the throttle cross-section is thereby reduced. The throttle resistance therefore becomes larger. The pressure in the valve chamber 35 is therefore substantially constant. Under this pressure, a predetermined quantity of oil is delivered from the nozzle 40 with the cut-off valve 38 open. When the pump piston 8 executes strokes that are longer than corresponding to this quantity, the pressure in the feed conduit 15 rises. This pressure rise has a damping effect on the oscillating system so that the strokes are automatically limited to the required value.

Figure 2:
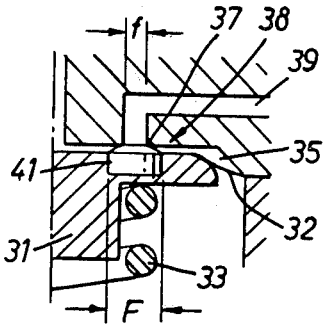
FIG. 2 is an enlarged representation of the cut-off valve in the closed position.
Figure 3:
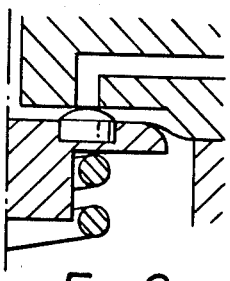
FIG. 3 shows the cut-off valve during the opening or closing phase.
Figure 4:
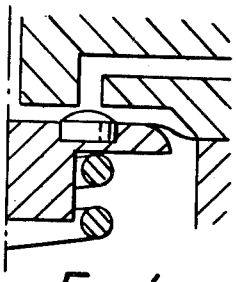
FIG. 4 shows the cut-off valve in the open position.

With respect to the function of the cut-off valve, reference is made to FIGS. 2 to 4. In FIG. 2, it is assumed that the pump is switched off. The desired value spring 33 presses the supporting member 31 upwardly and therefore presses the closure member 41 in the form of the elastic pad against the cut-off valve seat 37. The latter has the diameter $f$ whilst the closure member has a diameter F. On switching on the pump, the pressure in the valve chamber 35 rises gradually. The supporting member 31 moves downwardly against the force of the desired value spring 33 (FIG. 3). This causes the elastic pad 41 to expand so that the cut-off valve is still closed. The pressure existing in the valve chamber 35 merely acts on the annular surface $(F - f)$. As soon as this force is sufficient within the scope of the other position of the supporting member to compress the closure member 41 until a small aperture is obtained at the valve seat 37, the pressure existing in the valve chamber 35 acts on the entire surface F of the closure member and compresses same (FIG. 4). This results in sudden opening. If, during operation, the pump pressure drops so that the compressed closure member 41 comes to lie on the valve seat 37, compression is effected only by the pressure acting on the annular surface $(F - f)$. One thereby obtains a sudden sealed closure of the cut-off valve, as is desired in order to avoid drips.

By way of example, it is assumed that the operating pressure of the pump amounts to 10 atmospheres and that the diameter of the cut-off valve seat is 2 mm and of the elastic pad 3 mm. One then has the surfaces $f = 3$ mm$^2$ and $F = 7$ mm$^2$. When the cut-off valve is closed but the opening pressure of 10 atmospheres has almost been reached, a pressure of about 400 g acts on the annular surface $(F - f)$ of the elastic pad because no pressure obtains in the nozzle conduit 39. If, now, the pad is removed from the seat at an increased pressure, the pressure acts on the entire pad surface, which corresponds to a force of about 700 g. When the pad has an elasticity with an operating range between 400 and 700 g, one obtains the desired snap action (on-off effect). This is because the distribution the oil occurs extremely rapidly over the entire surface of the pad.

Conversely, closure is also obtained rapidly. When the elastic pad approaches the seat 37, the force acting on the pad is reduced. The pad 'grows' practically towards the seat 37 under its elasticity, this again occurring so rapidly that a rapid cut-off is ensured. The cut-off pressure is somewhat below the opening pressure. However, this is desired because small pressure fluctuations which do not interfere with the nozzle operation should not yet cause the cut-off valve to close.

Figure 5:
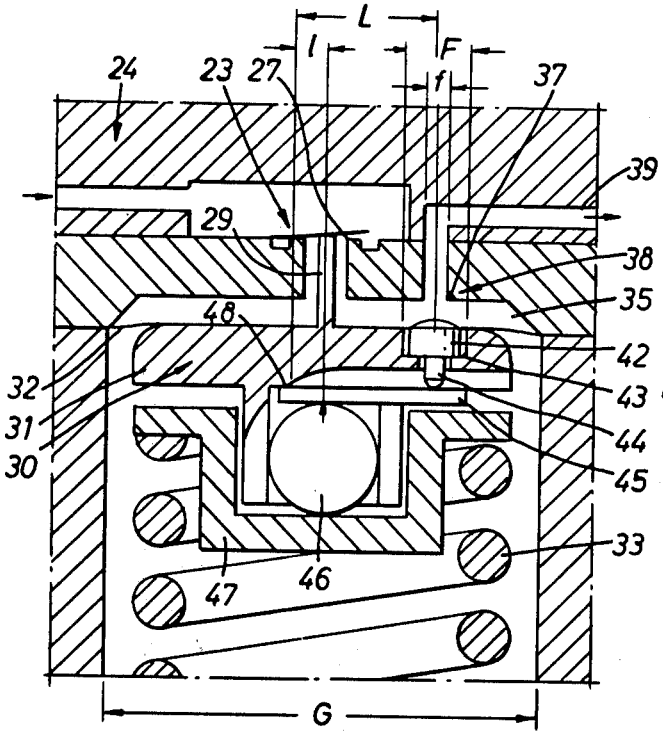
FIG. 5 is a different embodiment of a combined cut-off and pressure regulating valve.
Figure 6:
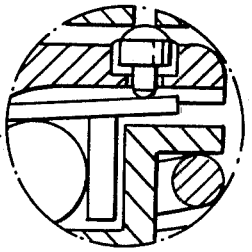
FIG. 6 shows the cut-off valve during the opening or closing phase.

In the embodiment of FIGS. 5 and 6, the same reference numerals as in FIGS. 1 to 4 are used for analogous parts. In this case the closure member 42 of the cut-off valve 38 is a cylinder which is curved at the top, covered by the diaphragm 32, rests on a shoulder 43 of the supporting member 41 in the rest position and comprises a pin extension 44. This is supported on a lever 45 which is centrally supported on a cylindrical bearing 46 which rests in a cap 47 loaded by the desired value spring 33. The lever is supported on the opposite side at a point 48 of the supporting member 31.

It is assumed that the valve seat 37 again has a cross-sectional area $f$, that the closure member 42 has an area F and that the valve chamber 35 has an area G. Related to the point 48, the supporting point at the bearing 46 has a lever arm 1 and the supporting point of the pin 44 has a lever arm L. The aim is to select the conditions so that the following relationship applies:

$$(G/F) < (L/1) < (G/F-f).$$

As long as the pump is not in operation, the entire arrangement is disposed, as shown in FIG. 5, somewhat higher so that the closure member 42 seals the valve seat 37. If, now, the pressure in the valve chamber 35 rises, the supporting member 31 moves downwardly. In this way, however, the closure member is pressed further upwardly by the lever 45 so that the closure position is retained (FIG. 6). As soon as the pressure acting on the annular surface (F – *f*) is now sufficient to overcome the part of the force of the desired value spring that is transmitted by the lever, the valve opens; the entire area F is immediately subjected to the pressure and one obtains the desired snap effect for opening. Similar conditions apply during closure. When the closure member 42 approaches the valve seat 37 and the pressure within the area *f* drops off, the closure member 42 'grows' towards the seat 37 so that impact closure is obtained.

The precise size relationships for the individual areas or lever lengths are calculated for a certain operating pressure. The cut-off valve will then however also work in a comparatively large range of the operating pressure. If, for example, dimensioning took place for 10 atmospheres, reliable operation is still possible at a pressure setting of 7 – 14 atmospheres.

The cut-off valve is not only suitable for the illustrated magnetic pump feed installation but also for all other installations, e.g. those with gear pumps.

I claim:

1. A cutoff valve unit for an oil burner assembly comprising a casing defining a chamber, inlet and outlet passages in said casing having communication with said chamber, said outlet passage having a valve seat, a movable adjustment element in said chamber having a disk shaped portion, spring means biasing said element in the direction of said valve seat, a diaphragm in said chamber between said disk shaped portion and said valve seat, a closure member having a face which engages said valve seat, said closure member being attached to said disk shaped member with said face being displaceable relative to said disk shaped member, said face having a larger diameter than said valve seat, said closure member extending through said disk shaped portion, a second element between said disk shaped portion and said spring means, said second element being movable relative to said adjustment element, a bearing between said elements, a lever having one side thereof engaging said bearing and the other side thereof engaging said adjusting element and said closure member at spaced apart points, said bearing being between said points.

* * * * *